US010429020B2

(12) United States Patent
Grandadam

(10) Patent No.: US 10,429,020 B2
(45) Date of Patent: Oct. 1, 2019

(54) WIRELESS PORTABLE LIGHT SOURCE SYSTEM WITH MULTIPLE MOUNTING AND CONTROL MODES

(71) Applicant: Promier Products, Inc., Peru, IL (US)

(72) Inventor: Cody Duane Grandadam, Peru, IL (US)

(73) Assignee: Promier Products, Inc., Peru, IL (US)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 15/812,852

(22) Filed: Nov. 14, 2017

(65) Prior Publication Data

US 2018/0135819 A1 May 17, 2018

Related U.S. Application Data

(60) Provisional application No. 62/421,697, filed on Nov. 14, 2016, provisional application No. 62/461,516, filed on Feb. 21, 2017.

(51) Int. Cl.
*F21S 9/02* (2006.01)
*F21K 9/232* (2016.01)
(Continued)

(52) U.S. Cl.
CPC ..... *F21S 9/02* (2013.01); *F21K 9/232* (2016.08); *F21L 4/00* (2013.01); *F21S 8/031* (2013.01);
(Continued)

(58) Field of Classification Search
CPC .. F21S 9/02; F21S 8/031; F21V 21/08; F21V 23/0435; F21V 21/0965; F21V 23/0428; F21K 9/232; F21L 4/00
See application file for complete search history.

(56) References Cited

U.S. PATENT DOCUMENTS 4,095,316 A * 6/1978 Gabriel ..... F16B 45/02 226/200
5,087,209 A * 2/1992 Faucher ..... H01R 13/6392 439/218
(Continued)

FOREIGN PATENT DOCUMENTS

CN 201884957 6/2011
CN 202118534 1/2012
(Continued)

OTHER PUBLICATIONS

Wayback Machine Web archive of Miles Kimball website, Sep.-Oct. 2015 https://web.archive.org/web/20150923200148/http://www.mileskimball.com:80/buy-nnobile-led-light-bulb-353158 (Year: 2015).*
(Continued)

*Primary Examiner* — Evan P Dzierzynski
(74) *Attorney, Agent, or Firm* — Barnes & Thornburg LLP

(57) ABSTRACT

A portable light bulb system includes a bulb that is removably coupled to a mounting bracket that is affixed to a support surface. The bulb includes an internal battery power supply and a LED light engine. The system also includes a wireless module communication device configured to wirelessly communicate with the bulb. The portable light bulb system is capable of being configured in a first use position where operation of the bulb provides illumination to a region proximate the mounting bracket affixed to the support surface. An operator can disconnect the bulb from the bracket and bring the bulb to a second use position where operation of the bulb provides illumination to the second region. The operator can then return the bulb to the bracket at the first use position, or bring the bulb to yet another location for illumination.

25 Claims, 14 Drawing Sheets

(51) Int. Cl.

| | |
|---|---|
| ***F21L 4/00*** | (2006.01) |
| ***F21S 8/00*** | (2006.01) |
| ***F21V 21/02*** | (2006.01) |
| ***F21V 21/08*** | (2006.01) |
| ***F21V 21/096*** | (2006.01) |
| ***F21V 23/04*** | (2006.01) |
| *F21Y 115/10* | (2016.01) |

(52) U.S. Cl.

CPC ..... *F21V 21/02* (2013.01); *F21V 21/08* (2013.01); *F21V 21/0965* (2013.01); *F21V 23/0428* (2013.01); *F21V 23/0435* (2013.01); *F21V 23/0407* (2013.01); *F21Y 2115/10* (2016.08)

(56) References Cited

U.S. PATENT DOCUMENTS

| | | | | |
|---|---|---|---|---|
| 5,382,181 | A | 1/1995 | Ortiz | |
| 5,383,381 | A | 1/1995 | Graham | |
| 5,596,247 | A | 1/1997 | Martich et al. | |
| D531,741 | S | 11/2006 | Takahashi | |
| D548,369 | S | 8/2007 | Bembridge | |
| D549,360 | S | 8/2007 | An | |
| D553,267 | S | 10/2007 | Yuen | |
| D583,989 | S * | 12/2008 | Khubani | D26/138 |
| D602,614 | S | 10/2009 | Takahashi | |
| D629,535 | S | 12/2010 | Lee | |
| 8,084,963 | B2 | 12/2011 | Chandler et al. | |
| 8,328,582 | B1 | 12/2012 | Carley et al. | |
| D691,292 | S | 10/2013 | Qiu | |
| 8,669,716 | B2 | 3/2014 | Recker et al. | |
| 9,055,642 | B2 | 6/2015 | Maa et al. | |
| 9,081,269 | B2 | 7/2015 | Conti | |
| 9,541,262 | B2 | 1/2017 | Kohn et al. | |
| 9,657,928 | B1 * | 5/2017 | Jacobson | F21V 23/04 |
| 9,909,720 | B1 | 3/2018 | Turudic | |
| 9,918,371 | B2 | 3/2018 | Jacobson | |
| 9,920,888 | B1 | 3/2018 | Springer | |
| 2004/0120142 | A1 * | 6/2004 | Galli | H01H 36/00 362/191 |
| 2007/0211481 | A1 * | 9/2007 | Cooper | F21S 6/001 362/392 |
| 2007/0291477 | A1 | 12/2007 | Khubani | |
| 2008/0165529 | A1 * | 7/2008 | Man | F21L 4/005 362/196 |
| 2008/0273348 | A1 | 11/2008 | Klohn et al. | |
| 2010/0110670 | A1 | 5/2010 | Werth et al. | |
| 2010/0134047 | A1 * | 6/2010 | Hasnain | F21V 23/0442 315/302 |
| 2010/0147913 | A1 * | 6/2010 | Corets | A47G 29/083 224/269 |
| 2012/0057334 | A1 | 3/2012 | Robinson | |
| 2012/0182726 | A1 * | 7/2012 | King | F21S 9/037 362/183 |
| 2013/0308306 | A1 | 11/2013 | Hootman et al. | |
| 2014/0070703 | A1 | 3/2014 | Chen et al. | |
| 2014/0265836 | A1 | 9/2014 | Nourbakhsh et al. | |
| 2014/0268841 | A1 | 9/2014 | Stockman | |
| 2015/0356894 | A1 * | 12/2015 | Petrocy | G09F 13/005 40/545 |
| 2016/0073479 | A1 | 3/2016 | Erchak et al. | |
| 2016/0223175 | A1 | 8/2016 | Yang | |
| 2016/0270148 | A1 | 9/2016 | Filipovic et al. | |
| 2017/0241596 | A1 * | 8/2017 | Chien | F21K 9/232 |
| 2018/0084622 | A1 | 3/2018 | Chen | |

FOREIGN PATENT DOCUMENTS

| | | |
|---|---|---|
| CN | 202118845 | 1/2012 |
| CN | 103000036 | 3/2013 |
| CN | 203090292 | 7/2013 |
| CN | 103672480 | 3/2014 |
| CN | 204345498 | 5/2015 |
| CN | 204437844 | 7/2015 |
| WO | WO2007/128126 | 11/2007 |
| WO | 2011/094444 | 8/2011 |

OTHER PUBLICATIONS

Hotook LED Emergency Light, available at https://www.aliexpress.com/item/7W-led-emergency-light-change-led-Batteries-Bulb-lighting-E27-Lamp-for-homendoorlighting-2835smd/1747358227.html?spm=2114.40010208.49.U1rAaa, at least as early as Mar. 30, 2016.

LED Light Bulb Lantern, available at https://www.yellowoctopus.eom.au/led-light-bulb-lantern-kikkerland, at least as early as Mar. 31, 2016.

Nightstick Dual Light with Magnet, available at http://www.brightguy.com/Nightstick/Nightstick+Dual+Light+with+Magnet, at least as early as Mar. 31, 2016.

Ullman LED Magnetic Work Light, available at goo.gl/xscMC1, at least as early as Mar. 31, 2016.

Battery Powered LED Dome Light, available at goo.gl.MFA6BE, at least as early as Mar. 30, 2016.

Mobile Led Light Bulb, commercially available by Mar. 27, 2016 from www.mileskimball.combuy-mobile-led-light-bulb-353158referrer=apiv1sli (3 pages).

"Light Bulb" Vintage, pictures taken on Jun. 9, 2016 by PAT Europe BV (3 pages).

International Search Report and Written Opinion dated Feb. 14, 2018 in corresponding PCT Application No. PCT/US17/61594 (9 pages).

Mobile LED Light Bulb, commercially available by Sep. 8, 2015 from https://www.amazon.com/miles-kimball-mobile-light-bulb/dp/b0153tsjge (4 pages).

* cited by examiner

WIRELESS PORTABLE LIGHT SOURCE SYSTEM WITH MULTIPLE MOUNTING AND CONTROL MODES

CROSS-REFERENCE TO RELATED APPLICATIONS

This application claims the benefit of Provisional Patent Application No. 62/461,516, filed Feb. 21, 2017 and Provisional Patent Application No. 62/421,697, filed Nov. 14, 2016, which applications are incorporated in their entirety herein by reference and made a part hereof.

FEDERALLY SPONSORED RESEARCH OR DEVELOPMENT

None

TECHNICAL FIELD

This disclosure relates to a portable light bulb system. More particularly, to a portable, battery powered light bulb system including a bulb releasably secured to a mounting bracket affixed to a support surface to allow for multiple mounting configurations and control modes.

BACKGROUND

Electronic lighting is critical for indoor, outdoor and nighttime activities. Electronic lighting is typically provided from fixed locations, where a light source receives electrical power from a fixed and wired power source. Such lighting is useful in illuminating a particular area, but lacks the flexibility of more portable lighting systems. Generally, such a dual-purpose system would require extensive investments in parallel and separate fixed and portable lighting systems. Internally-powered portable lighting systems have been developed to provide illumination in more varied locations and situations. However, such internally-powered portable lighting systems are not optimized to provide illumination both in fixed locations and in varied locations. For example, conventional flashlights and lanterns are limited in the number of way including the ability to be easily mounted in a location and controlled by a remote switch.

Accordingly, there is an unmet need for a portable light bulb system able to provide illumination in a variety of configurations and situations.

SUMMARY

In some embodiments of the present disclosure, a portable light bulb system includes a bulb including a housing, a manually-operated switch, a main body, and an light source. The main body of the bulb has base portion and a neck portion, wherein the neck portion has at least one longitudinal fin and the base portion has plurality of rings that are arranged substantially parallel to each and not forming a continuous thread. The portable light bulb system also has a mounting bracket that has a projection that extends from a bracket flange. The projection is configured to receive an extent of bulb when the portable light bulb system is in a first use position. The portable light bulb system also is configured to have a second use position, where the bulb is removed from the mounting bracket, brought to a second region that is distant from the mounting bracket, and the operation of the bulb provides illumination to the second region.

In some embodiments of the present disclosure, a mounting bracket is configured to receive the bulb base, and a separable connector is configured to releasably secure the bulb base to the mounting bracket. Thus, the portable light bulb system provides the user with multiple mounting modes, including a hand-held mode where the bulb is held by a user's hand, a static mode where the bulb is releasably secured to the mounting bracket, a suspended mode where the bulb is suspended by a retractable securing element, and a magnetic mode where the bulb is magnetically releasably attached to a magnetic surface.

In some embodiments of the present disclosure, a portable light bulb system includes a bulb including a housing, a manually-operated switch, a main body, and an light source. The main body of the bulb has base portion and a neck portion, wherein the neck portion has at least one longitudinal fin and the base portion has plurality of rings that are arranged substantially parallel to each and not forming a continuous thread. The portable light bulb system also has a remote module that wireless controls the operation of the internal light source of the bulb. The operation of the bulb may be controlled by a remote module in a first use position, while being controlled by the manually-operated switch in a second use position.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
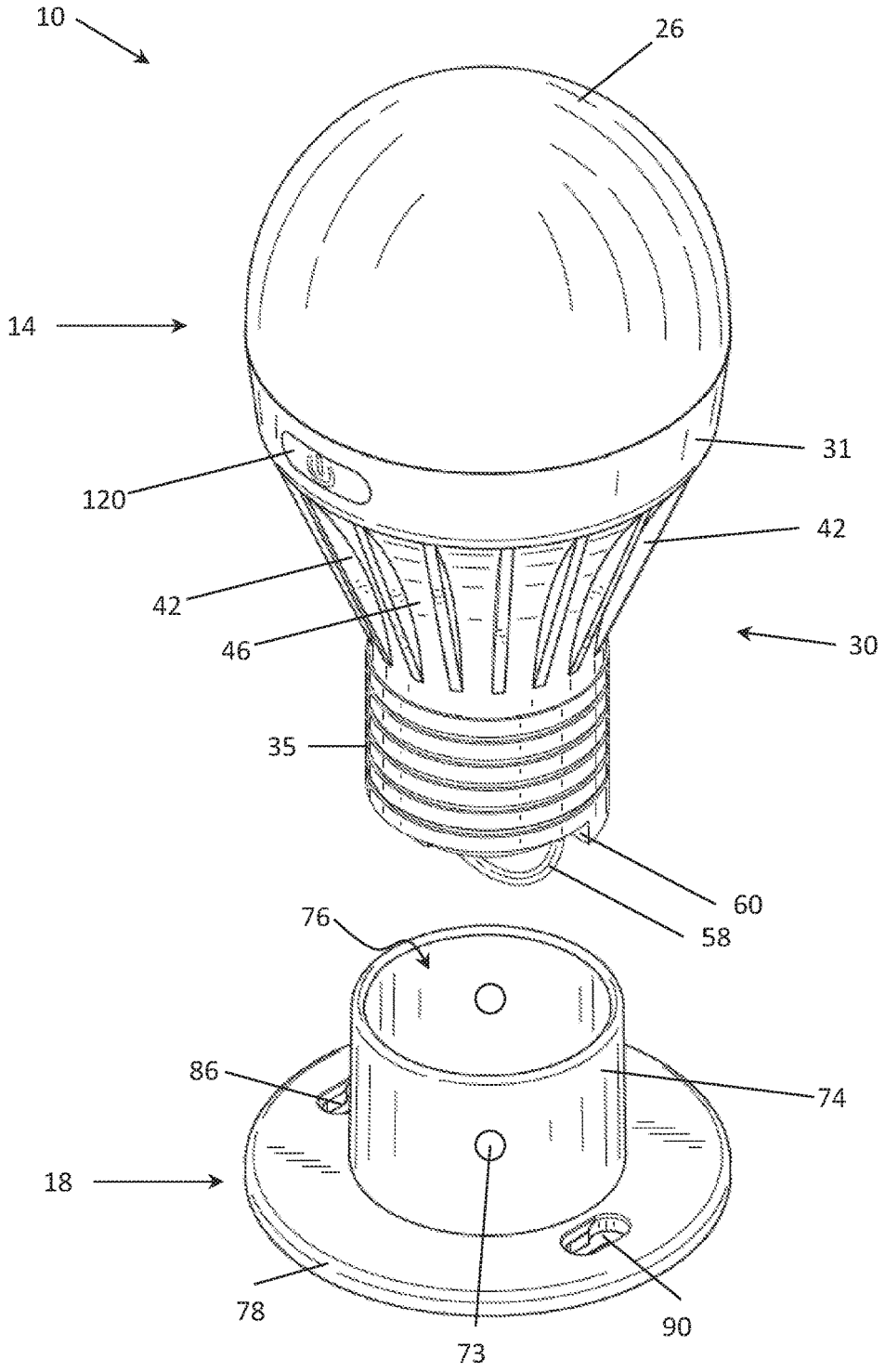
FIG. 1 is a perspective view of a portable light bulb system, showing a bulb disconnected from a mounting bracket, wherein a multi-positional securement member of the bulb is in a deployed position.

While this disclosure includes a number of details and embodiments in many different forms, there is shown in the drawings and will herein be described in detail particular embodiments with the understanding that the present disclosure is to be considered as an exemplification of the principles of the disclosed methods and systems, and is not intended to limit the broad aspects of the disclosed concepts to the embodiments illustrated.

FIGS. 1-15 show a portable light bulb system 10 including a releasably securable bulb 14, mounting bracket 18, and a module 11, 311, wherein the system 10 is configured to provide flexible illumination solutions in both stationary or fixed and portable situations. In particular, a user can releasably secure the bulb 14 to the mounting bracket 18 that is affixed to a support surface 22, such as a wall or ceiling. The user can subsequently detach the bulb 14 from the mounting bracket 18 and bring the bulb 14, while illuminated or off, to another location that is distant from the first location to allow for portable illumination at that location. The bulb 14, when detached from the mounting bracket 18, can be placed or supported in various arrangements, which will be described in further detail below. In addition, the user may use a module 11, 311 to remotely control the bulb's illumination. Accordingly, the portable light bulb system 10 provides the user with multiple mounting configurations (e.g., static with the mounting bracket 18, hand-held, or temporarily resting on or against a support surface 22), and multiple methods for controlling the bulb's illumination (e.g., manual, remote, or in response to a sensor).

As shown in FIGS. 1-9 and 11, the bulb 14 includes a housing 26 that is substantially hemispherical or dome-shaped and allows light to pass from an interior of the bulb 14 to an exterior of the bulb 14. The housing 26 may be translucent, which permits light to pass from the interior of the bulb 14 to an exterior of the bulb 14, while obscuring interior components from view. In other embodiments, the housing may be clear or colored. For example, the housing may be colored red for the use in a photographic darkroom or orange for use in a Halloween themed event. The housing 26 may be formed of organic materials, polymer, plastic, and/or other similar materials. In some embodiments, the housing 26 may be formed from a single piece of injection molded plastic. The use of these or similar materials will permit the housing 26 to be durable and/or substantially shatter proof. This in turn may permit the portable light bulb system 10 to be used in situations, where less durable light sources are not suitable, including camping or vehicle repair.

Figure 11:
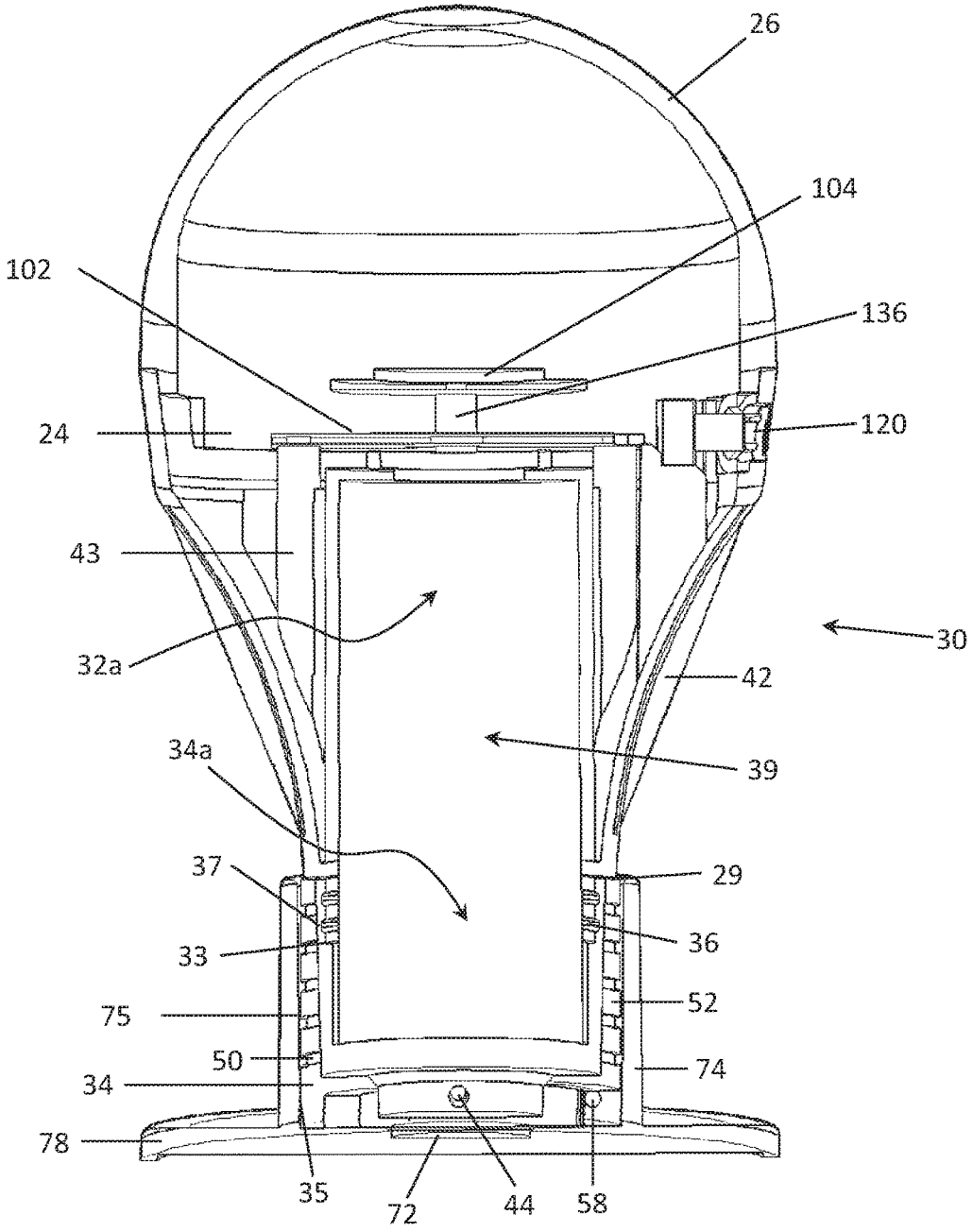
FIG. 11 is a cross-sectional view of the portable light bulb system taken along line 11-11 in FIG. 2.

The bulb 14 also has a main body 30 that includes a collar portion 31, a neck portion 32 and a base portion 34, wherein the neck 32 extends between the collar 31 and the base 34. As shown in FIG. 11, the housing 26 is coupled to the collar 31 by a housing edge 24 that is received within the collar 31. The housing edge 24 is cooperatively dimensioned with an internal surface of the collar 31, such that the housing edge 24 fits within the collar 31 and extends downwardly approximately 0.025 inches. The housing edge 24 also is recessed from the housing 26 to help ensure that the exterior surface of the housing 26 is substantially flush with the exterior surface of the collar 31. This arrangement helps ensure that the housing 26 will not detach from the collar 31 while the portable bulb system 10 is being used; thus protecting the user from contact with the electrical components of the bulb 14. In addition, this overlap helps protect interior bulb components from damage due to temperature, pressure, moisture or physical contact. Further, this overlap may allow the bulb 14 to be substantially water resistant, although the system 10 is not intended for underwater usage or prolonged exposure to water. It should be understood that the housing 26 may be coupled to the collar 31 in other ways, including by fasteners or a threaded mechanism. In other embodiments, the housing 26 may be formed as a one piece unit with the collar 31 or main body 30.

As shown in FIGS. 1, 3-5, and 8-11, the collar 31 includes a manually-operated switch 120. In particular, an opening and a recess are formed in the side wall of the collar 31 to permit the manually-operated switch 120 to be substantially flush with the exterior surface of the collar 31 and to allow for coupling of the manually-operated switch 120 with the internal electronics of the bulb 14. As described in greater detail below, the manually-operated switch 120 allows the user to control the operational mode of the internal light source 100. In other embodiments, the manually-operated switch 120 may be located in other portions of the bulb 14, such as the neck 32.

The neck 32 includes one or more fins 42 that extend outwardly from an external or outer wall 46 of the neck 32 and substantially extend between the collar 31 and the base 34. The fins 42 and the outer wall 46 provide the neck 32 with a cone shaped profile, best illustrated in FIG. 11. Also, the fins 42 may serve to increase the surface area of the outer wall 46. The increased surface area may provide additional gripping surface for the user and/or may aid in the dissipation of heat generated by various electrical components disposed within the bulb 14 to an exterior of the bulb 14. As shown in FIG. 11, the neck 32 may also have one or more internal fins 43 that extend inwardly from the inner surface of the neck 32 and intersect and/or form the battery compartment 39. These fins 43 provide additional support or rigidity to the main body 30, which helps to ensure that the bulb 14 is durable and/or substantially shatter proof. Additionally, these fins 43 increase the surface area of the main body interior, which may aid in the dissipation of heat generated by various electrical components disposed within the bulb 14. The collar 31, neck 32, and fins 42, 43 may be opaque in color, which limits the radial dispersion of the light. In addition, the opaque color obscures various electrical components disposed within the bulb 14 from view. The collar 31, neck 32, and fins 42, 43 may be formed of organic materials, polymer, and/or other similar materials. In some embodiments, the collar 31, neck 32, and fins 42, 43 may be formed from a single piece of injection molded plastic. Alternatively, the collar 31, neck 32, and fins 42, 43 may be formed from different materials or may be formed from the same materials, but may be separate components of the main body 30.

As shown in FIG. 11, the base 34 is removably coupled to the neck 32 and features an internal cavity 34*a*, that is cooperatively aligned with an internal cavity 32*a* of the neck 32 to form the battery compartment 39. In one embodiment, the base 34 and the neck 32 each include cooperatively dimensioned threads that mate to facilitate their removable coupling. The base 34 includes at least one thread 37 formed on an internal wall, and the neck 32 includes at least one external thread 36 formed on an external wall of the main housing 30 below the neck 32. Due to the engagement between these threads 36, 37 a lowermost portion 33 of the neck 32 extends into an uppermost portion 29 of the base 34. A battery cartage (not shown) resides within the battery compartment 39, and is configured to hold multiple batteries (e.g., 3 AAA). Alternatively, the battery compartment 39 may be configured such that is does not use a battery cartage (not shown) and only uses one battery (e.g., 1 AA). When the base 34 is properly secured to the neck 32, the battery cartage or battery makes an electrical connection with the electrical circuitry located in the main body 30. To remove the battery or batteries from the battery compartment 39, a user may rotate the base 34 in a counter-clockwise direction from the neck 32, which will in turn disconnects the external thread 36 from the thread 37. It should be noted, that the bulb 14 is battery powered and not powered by a conventional 110 volt circuit. This design facilitates the bulb's portability, its use as a flashlight, and the ability to install the portable light bulb system 10 in any location without the need for an electrician.

Figure 2:
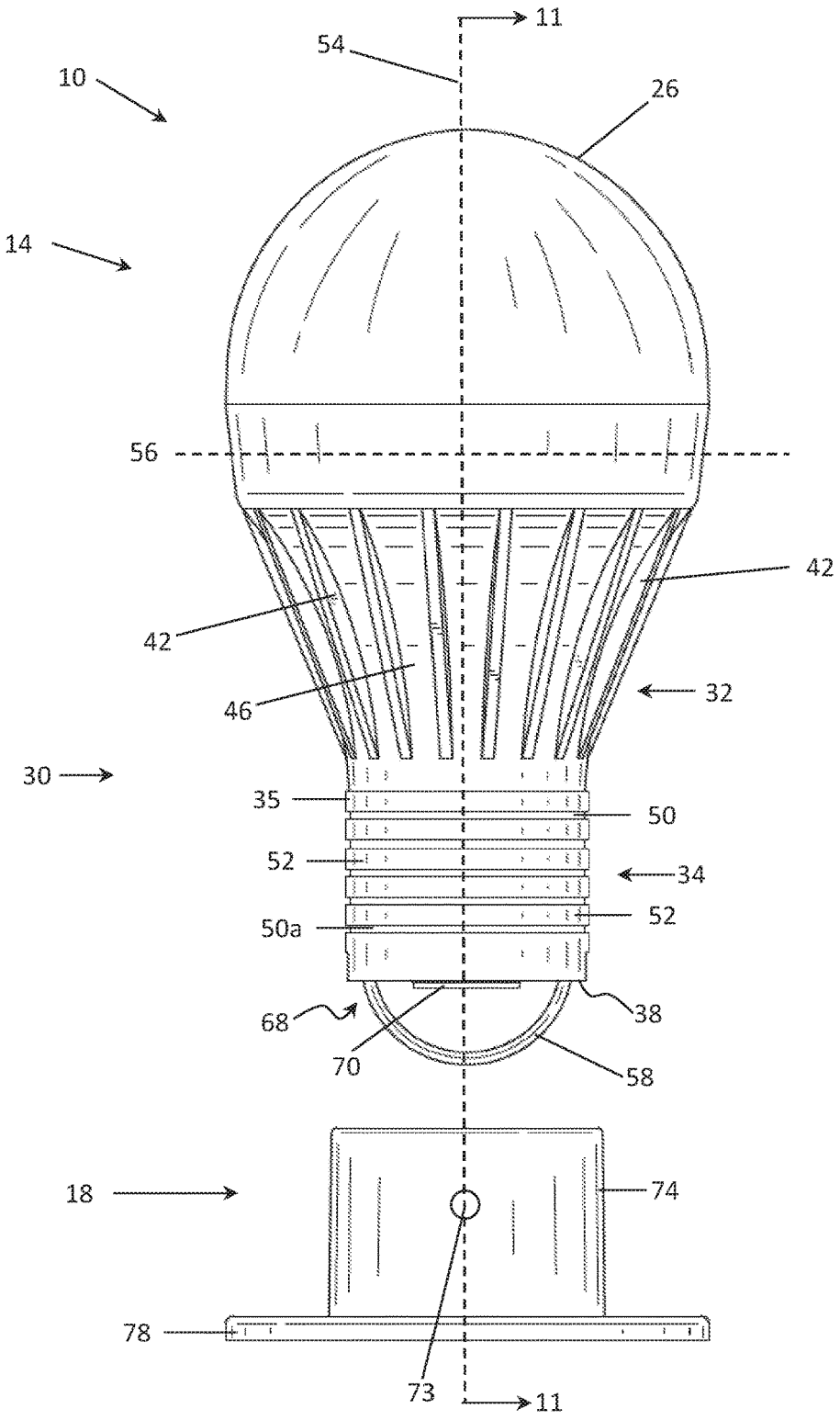
FIG. 2 is a rear view of the portable light bulb system of FIG. 1.
Figure 3:
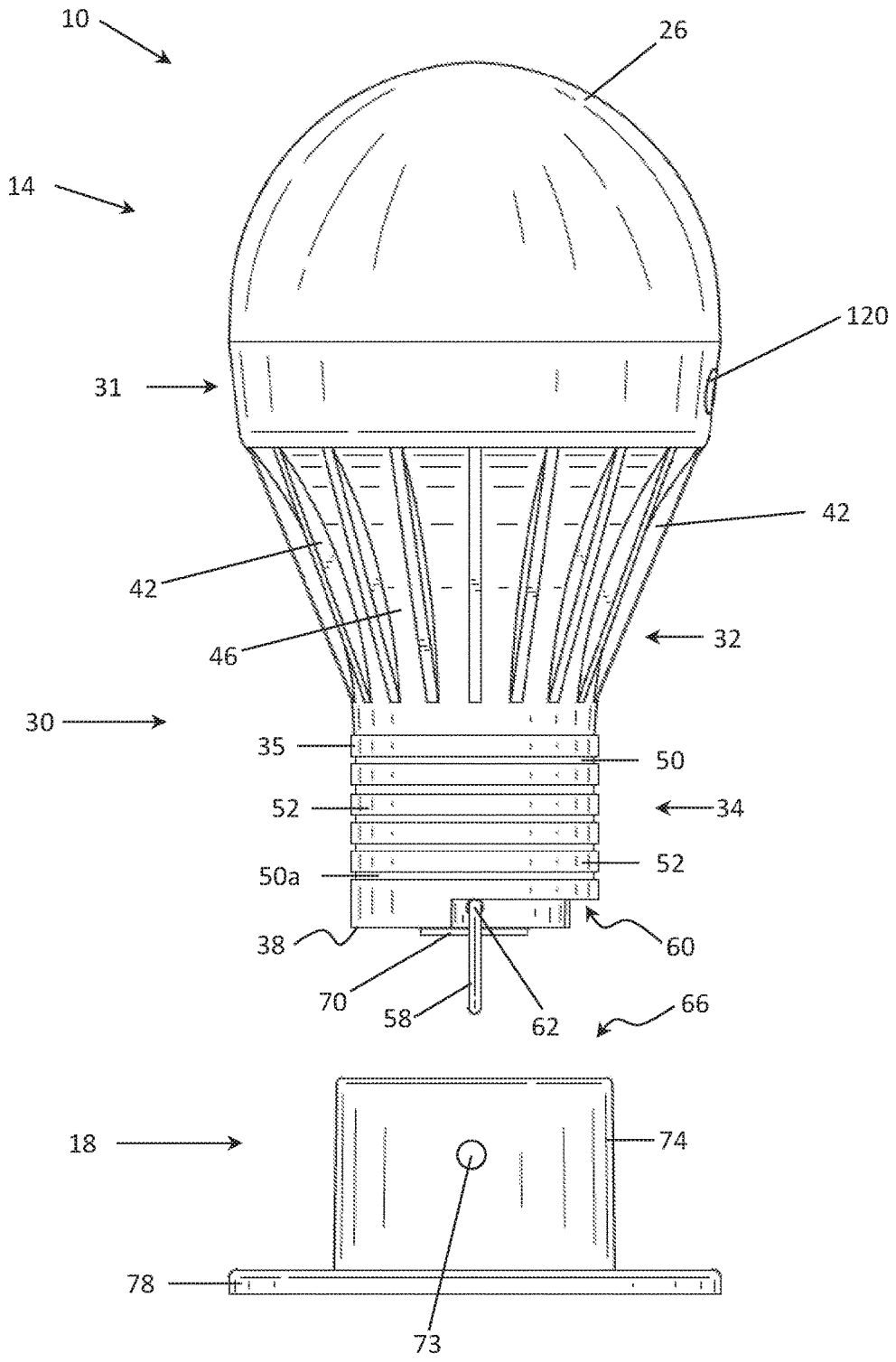
FIG. 3 is a left side view of the portable light bulb system of FIG. 1.

As shown throughout the Figures, including FIG. 2, the base 34 includes one or more grooves 50 that form rings 52, wherein a single ring 52 is positioned between a pair of grooves 50. The grooves 50 are recessed from an outer surface 35 of the base 34 while the rings 52 are not recessed. The grooves 50 and rings 52 are annular and continuous along their circumference, although each or both can be formed with discontinuous segments. The grooves 50 and rings 52 are arranged parallel to each other and are oriented substantially perpendicular to a longitudinal bulb axis 54 (see FIG. 2). Unlike threads found on a conventional light bulb (e.g., a E26 bulb), the grooves 50 and rings 42 do not form a continuous thread and do not lead to a lower surface 38 of the base 34. Because the grooves 50 and rings 42 do not form a continuous thread, the base 34 cannot be brought into threaded engagement with another component. Also, there is a smooth face 51 of the base 34 between the lowermost groove 50*a* and the lower bulb surface 38. In addition, unlike the threads found on conventional light bulbs, the groves 50 are thinner along the longitudinal axis 54 and are shallower along the lateral axis 56. This arrangement of grooves 50 and rings 52 also helps prevent the bulb 14 from being inadvertently placed in a conventional 110 volt electrical light bulb socket. In another embodiment of the base 34, the recessed grooves 50 are reconfigured to be raised grooves (not shown) that extend outwardly from the outer surface 35 of the base 34. Like the grooves 50 described above, the raised grooves in this alternative embodiment do not form a continuous thread and are thinner along the longitudinal axis 54.

Figure 4:
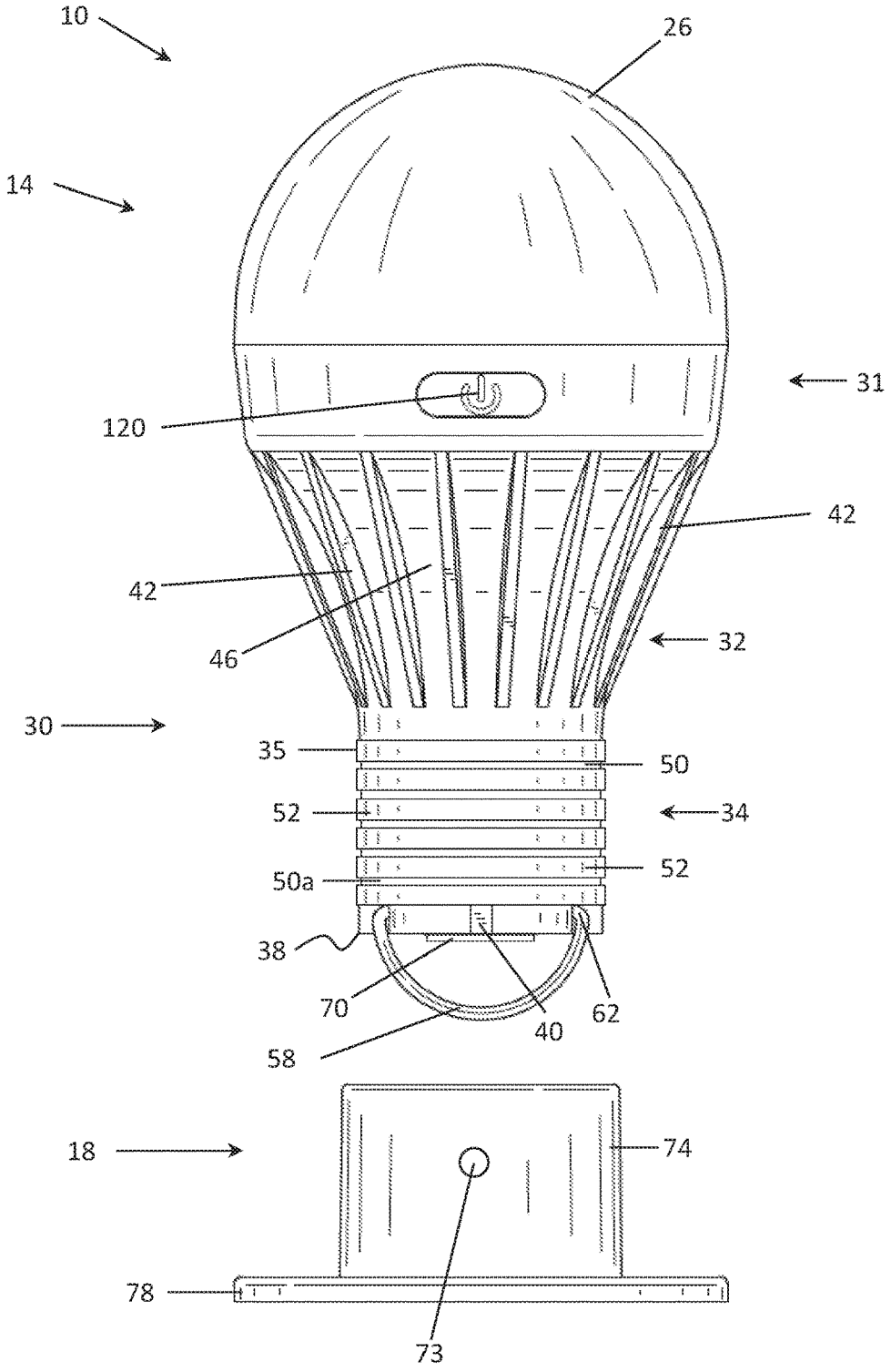
FIG. 4 is a front view of the portable light bulb system of FIG. 1.
Figure 5:
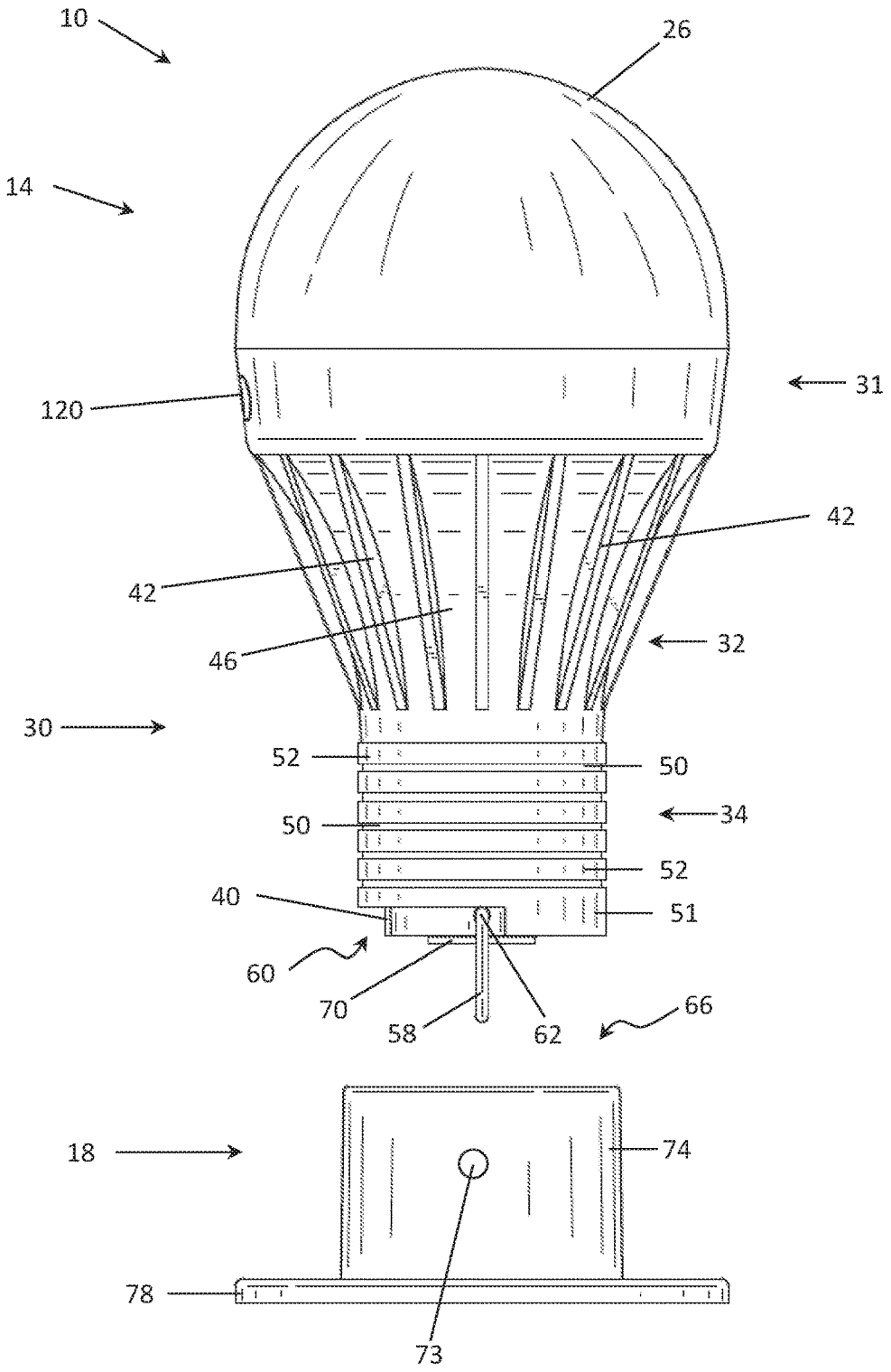
FIG. 5 is a right side view of the portable light bulb system of FIG. 1.
Figure 6:
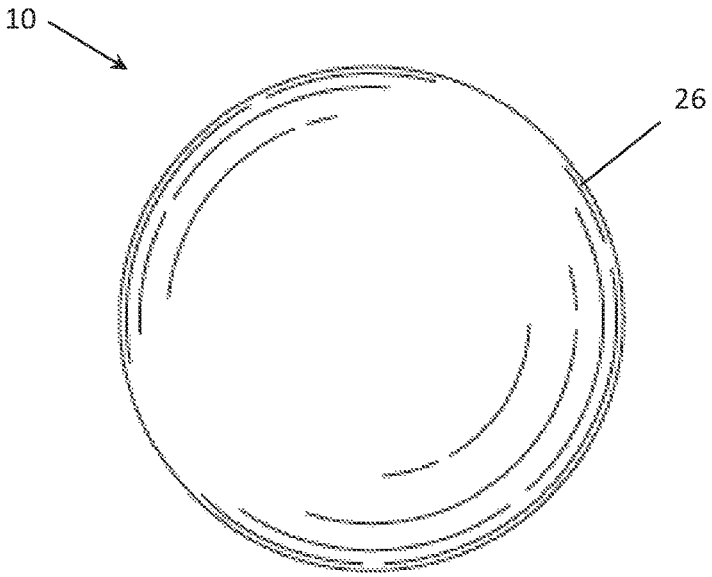
FIG. 6 is a top view of the portable light bulb system of FIG. 1.
Figure 9:
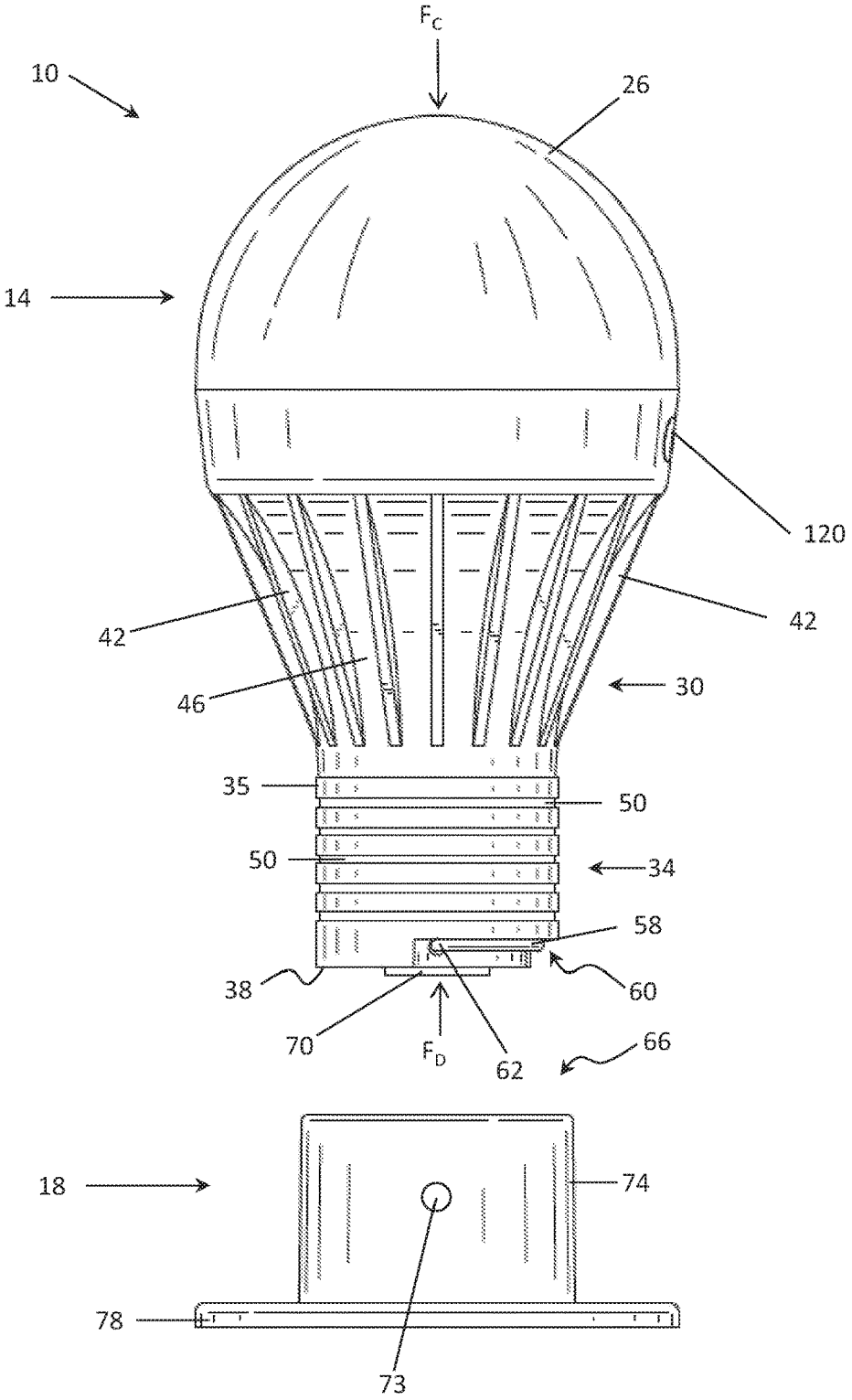
FIG. 9 is a left side view of the portable light bulb system, showing the bulb disconnected from the mounting bracket, wherein the multi-positional securement member is in a retracted position.

As shown in FIGS. 1-5 and 9, the base 34 of the bulb 14 includes a lower surface 38 and a multi-positional securement member 58 which is adapted to allow bulb 14 to be hung from a fixed point, such as on a hook (not shown). The multi-positional securement member 58 may have a curvilinear or semicircular shape to form a loop and may be formed from the same material as the base 34. The multi-positional securement member 58 is coupled to the base 34 at a securement point 62. Specifically, the multi-positional securement member 58 may have a linear extent (not shown) that extends into a hole or depression 44 formed in the base 34 (shown in FIG. 11). This arrangement allows the multi-positional securement member 58 to be moved between a plurality of positions, including a deployed position as best shown in FIGS. 1-5, a retracted position as best shown in FIG. 9, and intermediate positions between the deployed and retracted positions. Referring to FIGS. 4 and 5, the base 34 includes a retainer 40 adapted to ensure that the multi-positional securement member 58 remains in a retracted position wherein the retainer 40 applies a pressure, directed radially outward, on the multi-positional securement member 58 in the retracted position. It should be understood that the retainer 40 can be configured as a tab, projection or spring, which biases the multi-positional securement member 58 into the retracted position. In alternative embodiments the retainer 40 may be located on the multi-positional securement member 58 and extend radially inward towards the base 34, when the multi-positional securement member 58 is in the retracted position.

As shown in FIGS. 1, 3, 5, and 9, the base 34 also includes a recessed segment 60 formed in a lower portion of the base 34 and adjacent the lower surface 38. The recess 60 may be substantially arcuate in shape and may be formed parallel to the lower surface 38. When positioned in the retracted position, the multi-positional securement member 58 is substantially disposed within the recess 60 such that it is substantially flush with the lower surface 38. Alternatively, as shown in FIG. 9, the multi-positional securement member 58 may be recessed from the lower surface 38. Regardless of whether the multi-positional securement member 58 is substantially flush with lower surface 38 or recessed within the lower surface 38, the recess 60 helps ensure that the multi-positional securement member 58 does not prevent the lower surface 38 of the bulb from coming into contact with the base of the protrusion 74 or the support surface 22. In this manner, the retracted securement member 58 does not prevent the lower surface 38 of the bulb 14 from contacting a substantially planar support surface 22, such as a table or work surface, which improves the stability of the bulb 14. In the deployed position, the multi-positional securement member 58 extends below the lower surface 38, and portions of the multi-positional securement member 58 form a structure able to hang, support and/or mount the bulb 14 on various hooks, protrusions, strings, and/or fasteners. In other embodiments, the multi-positional securement member 58 is omitted from the base 34 and/or the base 34 lacks the recess 60.

As shown throughout the figures, the system 10 includes a means for releasably securing the base 34 of the main body 30 within the receptacle 76 of the mounting bracket 18. In particular, the securing means includes a first component positionally associated with the main body 30, preferably the base 34, and a second component positionally associated with the mounting bracket 18, preferably the receiver 76. In certain embodiments, the first component is a magnet 70 and the second component is a metal disk 72. Alternatively, the first and second components may be spring ball detent, elastically deformable protrusions that extend inwardly from the inner surface of the receiver 76, bayonet style connector, a pin and socket, or other similar types of connectors. It should be noted that, no rotation, meaning more than 360 degrees, is required for the disconnection force $F_D$ once the securing means is released.

As shown in FIGS. 2-5 and 9, the base 34 includes a base connector 68, such as the magnet 70. Although shown as extending beyond the lower surface 38 of the base 34, the magnet 70 can be recessed with the base 34 such that its outermost surface is flush with the lower surface 38. This arrangement enables the lower surface 38 to make substantial contact with the surface 22, which adds stability to the bulb 14 when placed on the support surface 22. In another embodiment, the magnet 70 is placed in the mold during the injection molding process and thus formed within the base 34 such that the magnet 70 resides against the lower surface 38. This configuration helps improve durability of the bulb 14 by ensuring that the magnet 70 cannot be accidentally dislodged from the base 34. The size of the magnet 70 is chosen such that it is capable of holding the bulb 14 in a stable position over time, when coupled to either the bracket 18 or a metallic support surface 22. The balancing of these factors may lead to the magnet 70 having a diameter that is less than half the diameter of the base 34 and capable of generating between 0.005 and 0.3 Tesla of force, preferably 0.1 Tesla. It should be understood that other sizes and magnets having diffing strengths may be used.

In certain embodiments, the base 34 may have a height along the longitudinal bulb axis 54 and defined between the lower surface 38 and an uppermost edge 29, which is less than the height of the housing 26 and less than half the height of the neck 32. The base 34 has an outer diameter, at its widest point provided by the rings 52, which is greater than the inner diameter of the socket that receives a conventional 110 volt electrical light bulb. For example, the base 34 has an outer diameter of 1.15 inches, while a conventional 110 volt electrical light bulb socket (e.g., Edison screw number 26, E26, or International Electrotechnical Commission standard sheet 7004-21A) has an inner diameter of approximately 1 inch. The increased diameter of the base 34 helps prevent the bulb 14 from accidentally being placed in a conventional 110 volt electrical light bulb socket. In addition, the increased dimensions of the bulb 14, namely at the base 34, provides a larger handle which may improve the user's handling and interaction with the bulb 14. Even if the base 34 was somehow forced into an E26 socket, it cannot be threaded within the socket because the base 34 lacks threads, as neither the rings 52 nor the grooves 50 form a thread.

The base 34 can be formed of organic materials, metals, ceramics, polymers, plastic, and/or other similar materials. In some embodiments the base 34 may be formed from injection molded plastic and/or may be made from the same material as the main body 30. Like the main body 30, the bulb base may be opaque in color. The opaque color obscures various electrical components disposed within the bulb 14 from a user's view. In certain embodiments the base 34 may be a different color than the neck 32, while in other embodiments the base 34 may be the same color as the neck 32. One exemplarily embodiment includes where the base 34 is a chrome color and the neck 32 is a white color.

The mounting bracket 18 includes a projection 74 that extends substantially perpendicular from a mounting bracket flange 78. In embodiment shown in the figures, the projection 74 is a substantially cylindrical projection, where the top surface of the flange 78 and the outer surface of the projection 74 intersect at approximately a ninety degree angle. While other degrees of intersection between the top surface of the flange 78 and the outer surface of the projection 74 may be used, a ninety degree angle may be beneficial because less material is used to fabricate the mounting bracket 18.

The projection 74 also defines a receiver 76 that is cooperatively dimensioned with the base 34 to allow for releasable insertion of the base 34, without rotation, into the receiver 76. The interior surface 74*a* of the projection 74 that defines the receiver 76 lacks threads and is substantially smooth, as best shown in FIG. 11. Thus, to couple the bulb 14 to the mounting bracket 18, the user may apply a connection force $F_C$ on the main body 30 that is directed towards the mounting bracket 18. This connection force $F_C$ is orientated substantially perpendicular to the mounting bracket flange 78 and/or substantially parallel to the longitudinal bulb axis 54 (see FIG. 2). It should be understood that the connection force $F_C$ may have a nominal angular component, which may be clockwise or counterclockwise that is less than 90 degrees, preferably less than 45 degrees, and most preferably less than 30 degrees. However, the connection force $F_C$ does not require the bulb 14 to be rotated, meaning the bulb 14 is not rotated 360 degrees or more to connect it from the bracket 18, which is unlike conventional bulbs and sockets. Once the base 34 is inserted into the receiver 76 it is releasably secured therein by a connector 66. In an embodiment, the connector 66 may be a metal disk 72, or an opposite polarity magnet, disposed within the projection 74, which attracts the magnet 70 in the base 34. The metal disk 72 or magnet may be adhered to the bottom of the receiver 76, or in an alternative embodiment the metal disk 72 or magnet may be formed within the mounting bracket flange 78.

The bulb magnet 70 and the metal disk 72 allow for the bulb 14 to be removed from the receiver 76 by a disconnection force $F_D$ that is directed away from mounting bracket 18. The disconnection force $F_D$ is orientated substantially perpendicular to the mounting bracket flange 78 and/or substantially parallel to the longitudinal bulb axis 54 (see FIG. 2). This disconnection force $F_D$ must be large enough to overcome the magnetic force between the bulb magnet 70 and the metal disk 72 to remove the bulb 14 from the receiver 76. In this embodiment, the user may apply this disconnection force $F_D$ by grasping the main body 30 or the housing 26 and pulling the bulb 14 away from the mounting bracket 18. It should be understood that the disconnection force $F_D$ may have a nominal angular component, which may be clockwise or counterclockwise that is less than 90 degrees, preferably less than 45 degrees, and most preferably less than 30 degrees. However, the disconnection force $F_D$ does not require the bulb 14 to be rotated, meaning the bulb 14 is not rotated 360 degrees or more to remove it from the bracket 18, which is unlike conventional bulbs and sockets. Once removed from the receiver 76 the bulb 14 may be taken to a location that is remote from the mounted location and used by the user in manner similar to that of a flashlight.

In alternative embodiments, the connector 66 is adapted to provide a friction fit between the inner surface 75 of the projection 74 and the outer surface 35 of the base 34. In this embodiment, the inner diameter of the projection 74 is nearly the same size as the diameter of the outer surface 35 of the base 34. This connection force $F_C$ will cause the wall of the projection 74 to elastically deform outwardly to accept the base 34 and when the base 34 is removed the wall of the projection 74 will return back to their static or normal position. In other embodiments, the connector 66 may be a single thread or a partial thread, which may require the connection force $F_C$ and disconnection force $F_D$ to have an angular component, but this angular component requires less than multiple 360 degree rotations. Still in further embodiments, the connector 66 may be spring loaded pins, hook-and-loop panels, adhesives, and/or other fasteners.

In other embodiments, the connector 66 may include supplemental securement elements 73. Supplemental securement elements 73 may include molding inwardly extending securement elements into the wall of the receiver 76. These inwardly extending elements may be designed such that they reduce the diameter of the receiver 76 to substantially the same size as the diameter or the bulb base at the grooves 50, which is less than the diameter of the base 34 at the rings 52. Thus, to couple the bulb 14 to the mounting bracket 18, a connection force is applied to the bulb 14, which will cause the wall of the projection 74 to deform outwardly to accept the rings 52 of the base 34. The continued application of the connection force on the bulb 14 will cause the wall of the projection 74 to return back to their static or normal position once the supplemental securement elements 73 are located within a groove 50. This may be repeated multiple times, until the base 34 comes into contact with the base of the projection 74. It should be understood that in alternative embodiments, the supplemental securement elements may include spring loaded pins, adhesives, and/or other types of similar fasteners.

Figure 7:
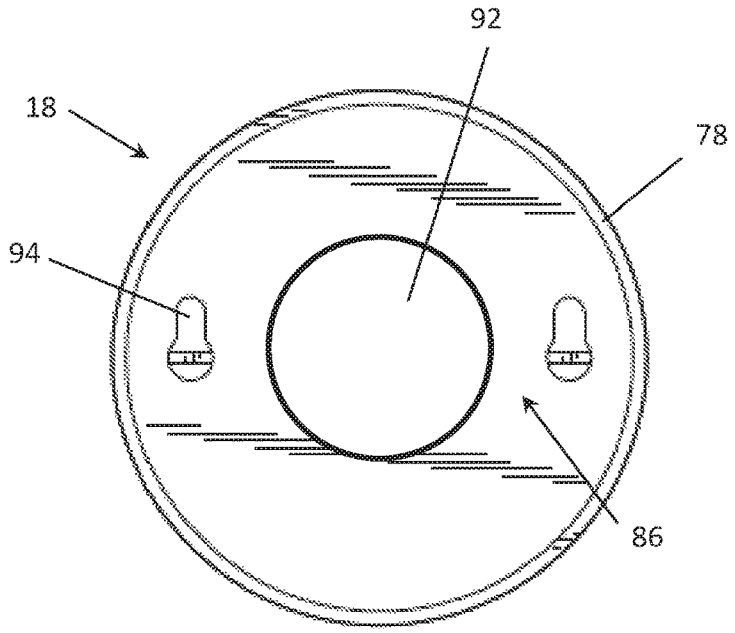
FIG. 7 is a bottom view of the portable light bulb system of FIG. 1.
Figure 8:
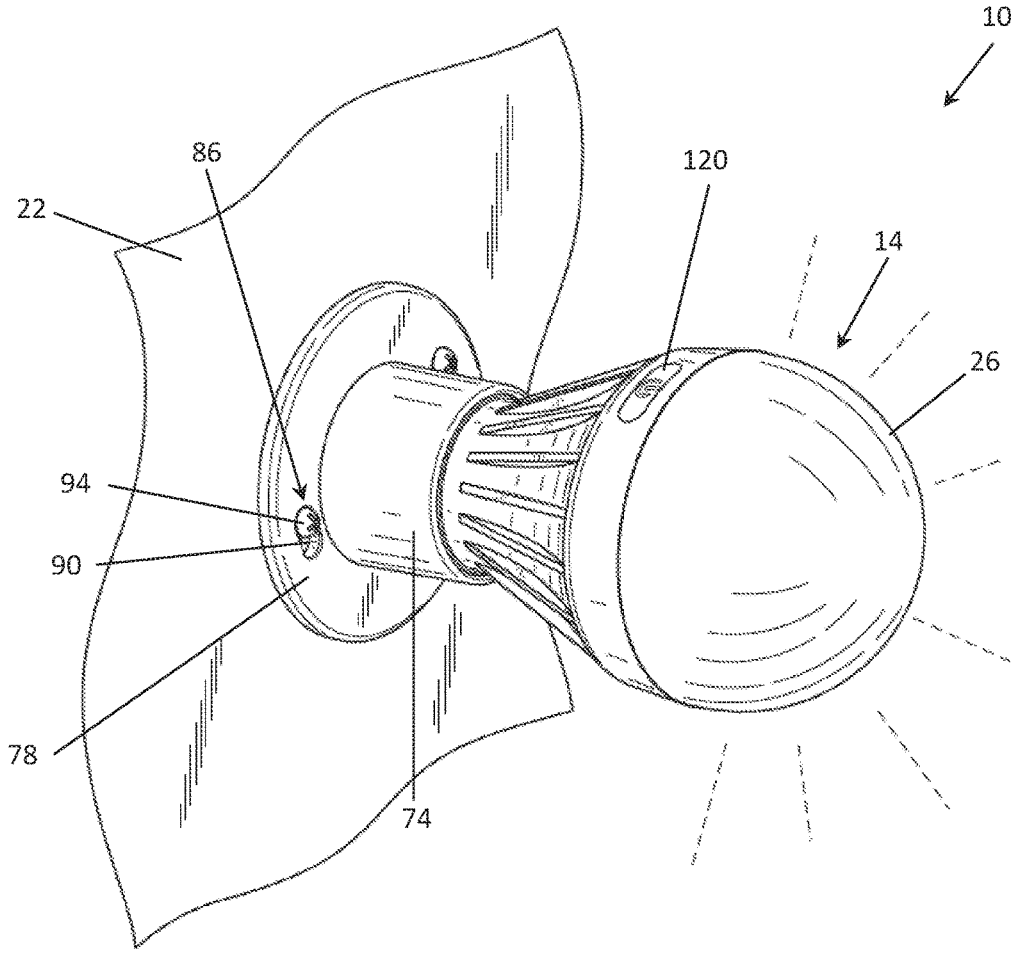
FIG. 8 is a perspective view of the portable light bulb system, showing an illuminated bulb that is releasably secured to a mounting bracket that is affixed to a support surface.

As shown in FIGS. 1, 7, and 8, the flange 78 may have a diameter that is approximately two times greater than the diameter of the projection 74. The flange 78 also includes a surface securement system 86 for securing the mounting bracket 18 to the surface 22. The surface securement system 86 includes, in some embodiments, apertures 90 for receiving various mechanical fasteners 94, as best shown in FIG. 8, which secure the mounting bracket 18 to the surface 22. In addition to the apertures for receiving various mechanical fasteners 94, the mounting bracket 18 may include adhesives 92, as best shown in FIG. 7. Providing both the apertures 90 and the adhesive 92, permits the user to mount the mounting bracket 18 in multiple ways. In further embodiments, the mounting bracket 18 may only have either an adhesive 92 or apertures for receiving various mechanical fasteners 94.

The mounting bracket 18, including flange 78 and the projection 74, can be formed of organic materials, metals, ceramics, polymers, plastic, and/or other similar materials. In some embodiments, the mounting bracket 18 can be formed from injection molded plastic and/or may be made from the same material as the main body 30. Also, the mounting bracket 18 may have a match the opaque color of the main body 30 may provide a pleasing aesthetic to the portable light bulb system 10.

Figure 10:
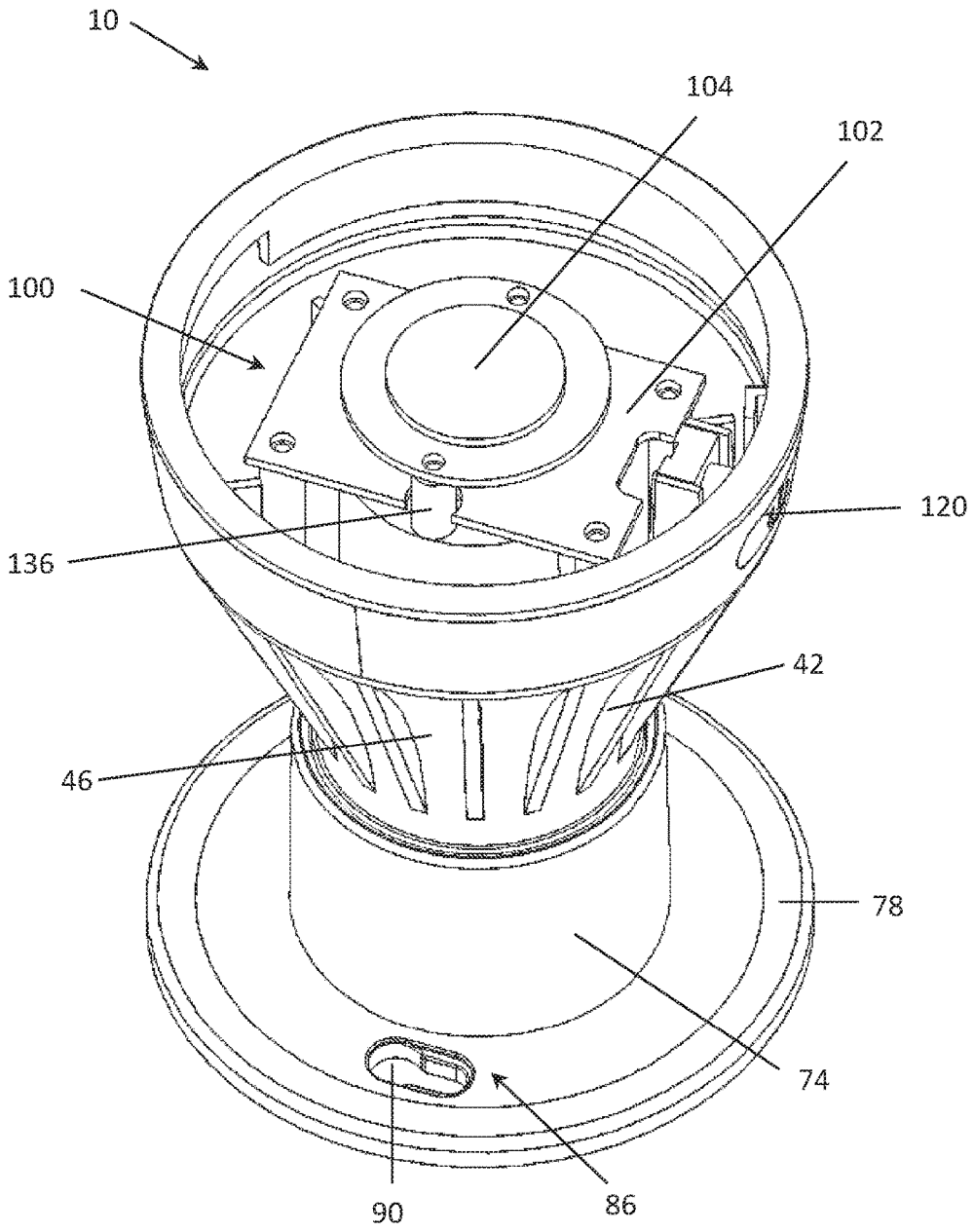
FIG. 10 is a perspective view of an upper region of the portable light bulb system, showing an internal light source disposed within the bulb.

As shown in FIGS. 10 and 11, the bulb 14 includes an internal light source 100 that is powered by a battery (not shown), which mounts in a battery cartage located within the battery compartment 39 of the neck 32. The internal light source 100 may be a light-emitting diode (LED) 104. The LED 104 may be comprised of multiple conventional LEDs, surface mounted LEDs, or Chip-on-Board (COB) LEDs. It should be understood that the number of LEDs and/or the size of the COB LED, which impacts the brightness of the bulb 14, may be balanced against the power consumption during the design/manufacture of the bulb 14. In certain embodiments, this balancing may lead to the selection of a COB LED that radiates between 100 and 400 lumens, preferably between 175 and 225 lumens, outside of the housing 26 when set at full brightness.

The LED 104 is electrically connected to the control circuitry 102 and mounted over the same by at least the post 136. The control circuitry 102 is comprised of various circuit components, including diodes, capacitors, inductors, and resisters. And in certain embodiments, the control circuitry 102 may include a radio and an antenna. The control circuitry 102 receives user inputs from various sources (e.g., a switch or the radio) and in response alters or changes the operational mode of the bulb 14 by modifying the power supplied to the internal light source 100. A user input received by the control circuitry 102 may be generated from a manually-operated switch 120. This manually-operated switch 120 allows the user to manually change the operational mode of the bulb 14 by sending a signal to the control circuitry 102, which in turn alters the illumination brightness or operational mode of the internal light source 100. In certain embodiments the operational modes includes constant illumination modes of varying brightness levels, zero illumination, and various flashing illumination modes.

Figure 15:
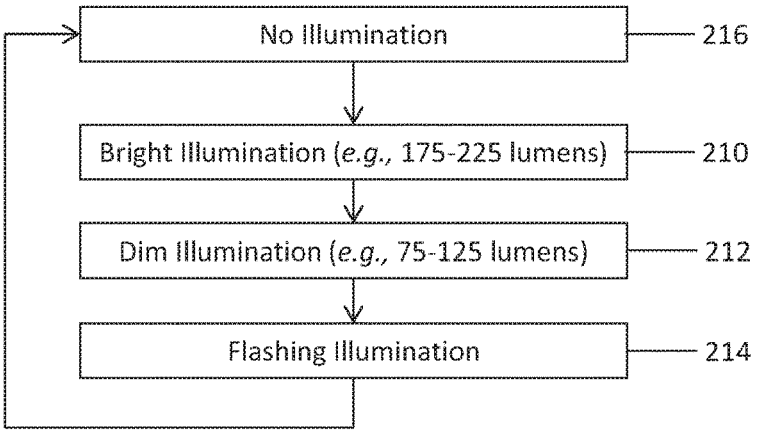
FIG. 15 is a flowchart describing the operational modes of the portable light bulb system in response to a user input.

FIG. 15 provides a flow chart that illustrates the operational modes of the internal light source 100. In certain embodiments, the default setting is no illumination mode 216, wherein the internal light source 100 is off. A first actuation of the switch 120 causes the internal light source 100 to go from the no illumination mode 216 to a bright illumination (e.g., 175-225 lumens) mode 210. A second actuation of the switch 120 causes the internal light source 100 to go from a bright illumination mode 210 to a dim illumination (e.g., 75-125 lumens) mode 212. A third actuation of the switch 120 causes the internal light source 100 to go from a dim illumination mode 212 to a flashing illumination mode 214. Finally, a fourth actuation of the switch 120 causes the internal light source 100 to go from a flashing illumination mode 214 to the no illumination mode 216. It should be appreciated that other operational modes may be available, including a mode that allows the user to select the brightness of the internal light source 100 by depressing and holding the switch 120 until the desired brightness is achieved. In this cycling mode, the internal light source 100 progress from no illumination 216 to bright illumination 210 and then slowly reduces the lumen output until there operational mode is returned to no illumination 216.

The system 10 can be arranged and illuminated in a plurality mounting configurations. In particular, the system 10 can be configured in a first use position, where the mounting bracket 18 is affixed to a support surface 22 and the bulb 14 is releasably secured to the mounting bracket 18 through application of the connection force $F_C$. In this first use position, the internal light source 100 of the bulb 14 can be illuminated to provide light in a region proximate to the mounting bracket 18. Additionally, the system 10 is configured in a second use position, where the bulb 14 may be disconnected from the mounting bracket 18 by the application disconnection force $F_D$ and brought to a second region distant from the mounting bracket. In second use position, the bulb 14 may be arranged in one of a plurality of positions, including (i) hand-held, (ii) temporarily resting on or against a support surface 22, or (iii) hung from a fixed point, such as on a hook, by the multi-positional securement member 58. In this second use position, the internal light source 100 of the bulb 14 can be illuminated to provide light in a region that is distant from to the mounting bracket 18. The user can return the system to the first use position by releasably connection the bulb 14 to the mounting bracket 18. Accordingly, the system 10 provides the user with immense flexibility in illuminating different areas, including areas distant from the support surface 22 where the mounting bracket 18 is affixed.

It should also be understood, that the operational mode of internal light source 100 can be changed regardless of the mounting configuration of the bulb 14. In particular, the operational mode of the internal light source 100 may be changed from a bright illumination mode 210 to a dim illumination mode 212, while the bulb 14 is hand-held, releasably secured to the mounting bracket 18, suspended by the multi-positional securement member 58, or magnetically releasably attached to a magnetic surface.

Figure 12A:
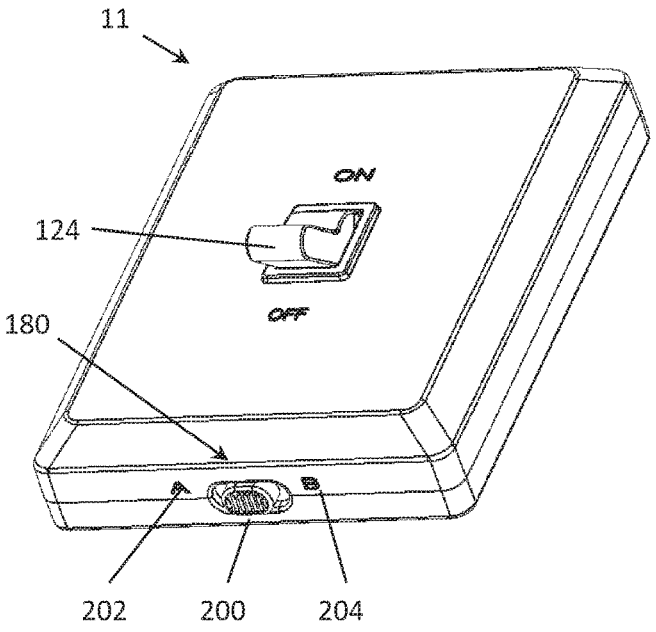
FIG. 12*a* is a perspective view of a remote wireless module of the portable light bulb system.

Another user input received by the control circuitry 102 may be generated from a remote wireless module 11, as shown in FIGS. 12*a,b* and 13*a,b*. Remote wireless module 11 may include various switches, motion sensors, light sensors, sound sensors, timers, cellphones, smartphones, or other similar devices. The use of a remote wireless module 11 is advantageous because it allows the bulb 14 to be placed in one location and the wireless module 11 to be in another location. For example, a user may mount the bulb 14, via the mounting bracket 18, to a closet ceiling, while placing the module 11 on a wall just outside the closet such that the module 11 can be sued to operate the bulb 14 while it is within the closet. The placement of the module 11 makes illuminating the internal light source 100 easy and allows for optimal placement of the bulb 14.

Two different non-limiting embodiments of a module 11 are disclosed in FIGS. 12*a,b* and 13*a,b*. In particular, the module 11 includes a module switch 124, a battery 125, one or more mounting features 130, a wireless communication device 126, and a channel selector 180. The module switch 124 may be placed in a plurality of positions, including an up position (not shown) or in a down position (shown in FIG. 12*a*). When the module 11 is paired with a bulb 14, the placement of the module switch 124 in the up position will send a wireless signal from the module 11 to the control circuitry 102 contained within the paired bulb 14 to illuminate its internal light source 100. In contrast, the placement of the module switch 124 in the down position or "off" (shown in FIG. 12*a*) will send a wireless signal from the module 11 to the control circuitry 102 contained within the paired bulb 14 to extinguish its internal light source 100. In other embodiments, the module switch 124 may have other positions that may control the internal light source 100 of the paired bulb 14 in other manners. For example, module switch 124 may be replaced by a switch that can be depressed, which in turn may allow the user to control the internal light source 100 of the paired bulb 14 in a manner that is similar to that of the switch 120 and the flow chart shown in FIG. 15. Alternatively, the depression type switch may be configured such that it the user can depress and hold the switch, which in turn causes the internal light source 100 of the paired bulb 14 to go from no illumination 216 to bright illumination 210 and then slowly reduces the lumen output until there operational mode is returned to no illumination 216. A further example includes a module switch 124, which is a rotational-style dimmer. In this example, the user may rotate the module switch 124 to select a brightness setting from a predefined number of brightness settings.

Figure 12B:
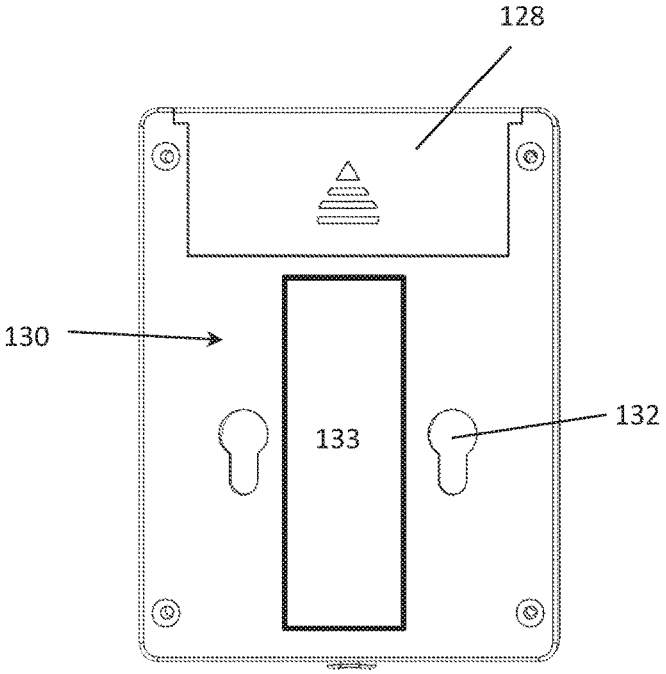
FIG. 12*b* is a rear view of the remote wireless module shown in FIG. 12*a*.

Referring to FIG. 12*b*, the module 11 includes a battery compartment (not shown), which is enclosed by a battery cover 128. The battery compartment holds at least one battery 125 (e.g., 1 AA), which supply electrical energy for the operations of the module 11. In some implementations, module 11 may not have a battery and instead may replace an existing switch and thus be connected to a conventional 110 volt circuit. The module 11 also includes mounting features 130 to permit the user to mount the switch to a surface 22 that is remote from the bulb 14. Such mounting features 130 may include one or a combination of apertures 132, clips, fasteners, adhesives 133 and/or any other mechanical attachment devices.

Figure 16:
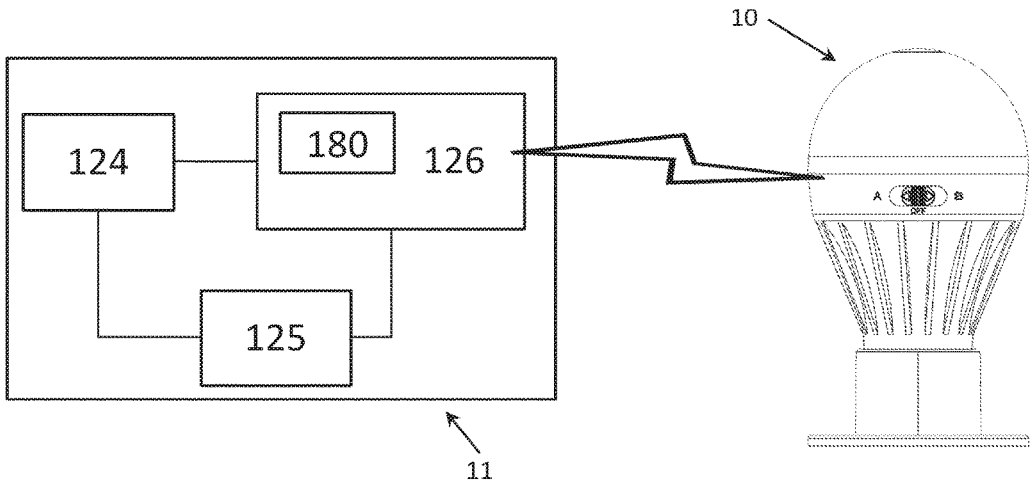
FIG. 16 is block diagram showing the circuitry contained within the wireless module of FIG. 12, which is wirelessly communicating with a paired bulb.

The wireless communication device 126 of the module 11 (see FIG. 16) communicates with the control circuitry 102 within the bulb 14, and includes a radio and an antenna. The radio may operate in a licensed or unlicensed band and could utilize any of the following types of technology including, but not limited to, infrared, cellular, Bluetooth, Wireless Fidelity (Wi-Fi or 802.11), Near Field Communications, modulated RF signals, time-frequency modulated RF signals, optical signals, and/or acoustic signals. In choosing a radio technology, it should be understood that the control circuitry 102 of the bulb 14 also includes a radio and antenna that operate using the same technology to enable the wireless communication device 126 that is contained within the module 11. In particular, the module 11 and the bulb 14 may utilize a radio-frequency technology that operates between 15-100 MHz because this radio-frequency technology utilize an unlicensed band, require little power, and are relatively inexpensive.

Figure 13A:
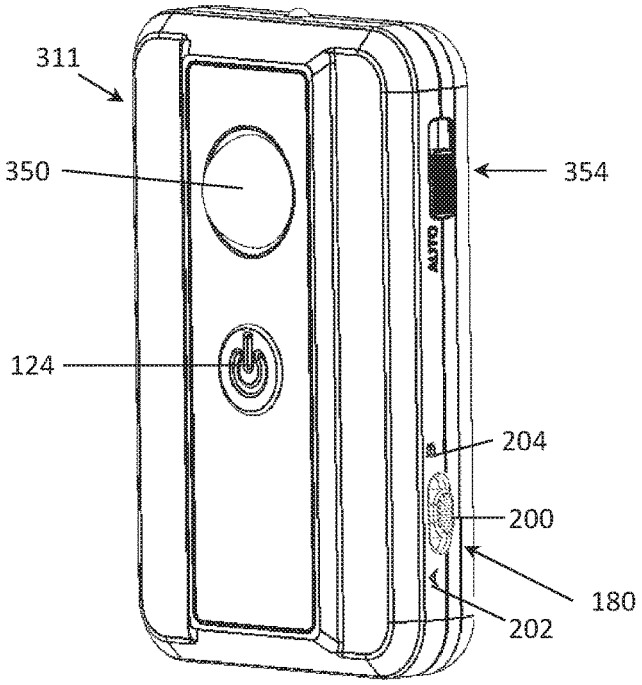
FIG. 13*a* is a perspective view of a remote wireless module of the portable light bulb system.
Figure 13B:
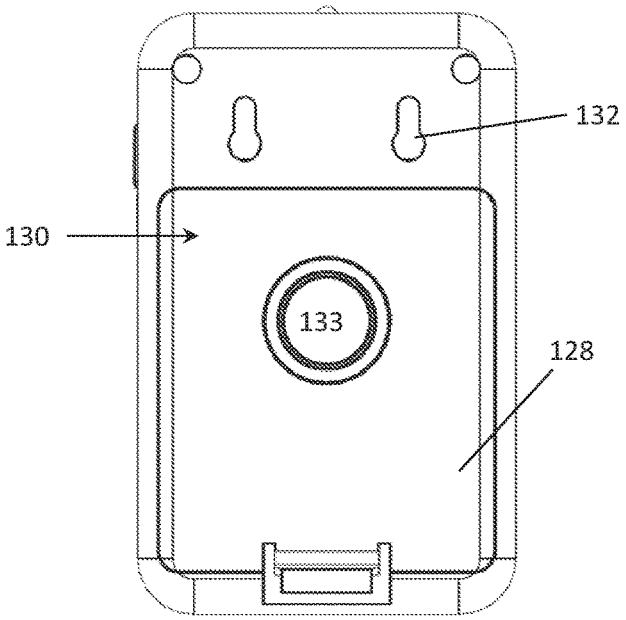
FIG. 13*b* is a rear view of the remote wireless module shown in FIG. 13*a*.
Figure 17:
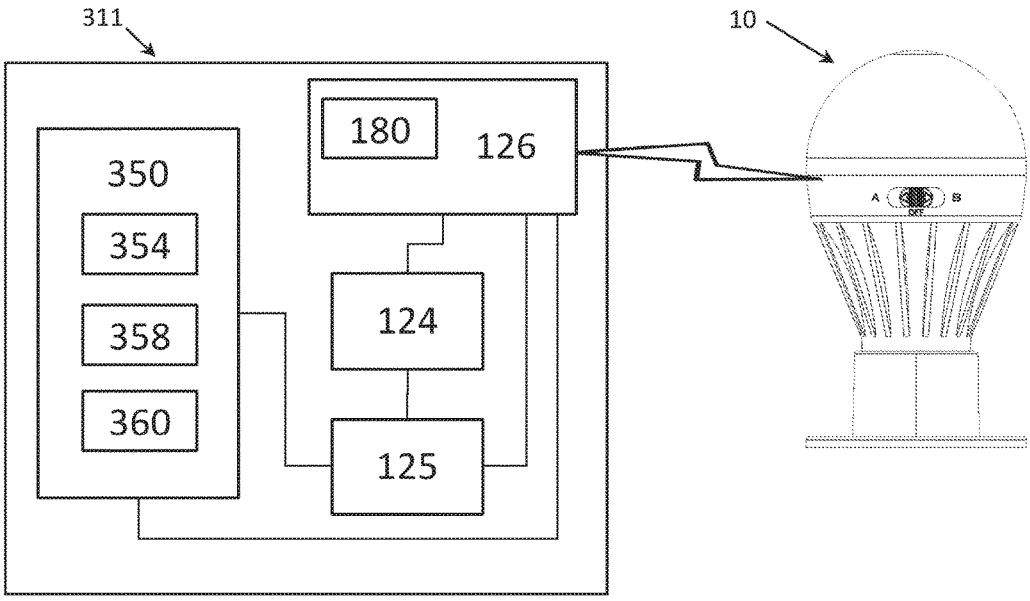
FIG. 17 is block diagram showing the circuitry contained within the wireless module of FIG. 13, which is wirelessly communicating with a paired bulb.

FIGS. 13*a*, 13*b*, and 17 discloses a module 311, which includes the module switch 124, the battery 125, one or more mounting features 130, the wireless communication device 126, the channel selector 180, a motion sensing unit 350, a mode selector 354, a time selector 358, and a sensitivity selector 360. The internal circuitry for the motion sensing unit 350 includes various circuit components that work together to detect motion of a person as he/she approaches and then departs the module 311. Exemplary types of motion sensing circuitry may include passive motion sensing circuitry or active motion sensing circuitry. A passive motion sensor may be preferred because of its low power and the fact that it primarily relies on the detection of body heat. In an alternative embodiment, the motion sensing circuitry may be an active motion sensor, which relies on ultrasonic sound waves to detect alterations in the reflections. Sensitivity selector 360 is coupled to or a part of the motion sensing unit 350. The sensitivity selector 360 can be adjusted such that pets or other animals may trigger motion sensing unit 350. It should be noted that the same reference numbers denote the same parts, which has the same functionality (e.g., 124 and 180).

The mode selector 354 is coupled to or a part of the motion sensing unit 350. The mode selector 354 can be set to multiple positions, which includes AUTO or OFF. Setting the mode selector 354 to AUTO permits the motion sensor 148 to control the operational mode or the illumination of the internal light source 100 of the paired bulb 14. For example, when the mode selector 354 of the module 311 is set to AUTO, the motion sensing unit 350 is active and waiting to detect motion of a user. Once the motion sensing unit 350 detects motion of a user, a signal is sent to the wireless communication device 126 of the module 311, which in turn transmits a signal to the control circuitry 102 contained within the paired bulb 14. The control circuitry 102 then illuminates the internal light source 100 for a predefined amount of time (e.g., 5 minutes). Once this predefined amount of time expires, the control circuitry 102 extinguishes the light that is emitted from the internal light source 100. It should be understood that this cycle is reset each and every time motion is detected by the motion sensing unit 350. Alternatively, if the mode selector 354 is set to the OFF position, then the motion sensing unit 350 will not be supplied with power and will not detect movement. When the mode selector 354 is set to the OFF position, the module switch 124 may be used to change the operational modes of the paired bulb 14, as discussed above in connection with the switch 120 and the flow chart shown in FIG. 15. It should also be understood in some embodiments, that module switch 124 can also act as an override to the motion sensing unit 350 to force the paired bulb 14 into an illuminated or a non-illuminated state.

The time selector 358 is coupled to or a part of the motion sensing unit 350. The time selector 358 may be set by the user in a plurality of positions, wherein each position represents a different amount of illumination time (e.g., one minute, three minutes, or five minutes). For example, the user may set the time selector 358 to three minutes and the mode selector 354 to AUTO. Then, once the motion sensing unit 350 detects motion of a user and determines that three minutes is set on the time selector 358, a signal is sent to the wireless communication device 126 of the module 311, which in turn transmits a signal to the control circuitry 102 contained within the paired bulb 14. The control circuitry 102 then illuminates the internal light source 100 for three minutes. After three minutes has passed, the wireless communication device 126 of the wireless motion sensor 148 sends a second signal to the paired bulb 14 to extinguish the internal light source 100. It should be understood that this cycle is reset each and every time motion is detected by the motion sensing unit 350. Alternatively, the control circuitry 102 could include circuitry that determines that three minutes has elapsed since the internal light source has been illuminated and as a result the control circuitry, without an additional signal from the wireless motion sensor 148, may extinguish the internal light source 100. It should be understood that in this alternative embodiment, the this cycle may be reset by the module 311 sending an additional signal to the pair bulb 14, which in turn will reset the timer contained within the control circuitry 102 of the bulb 14.

Figure 14:
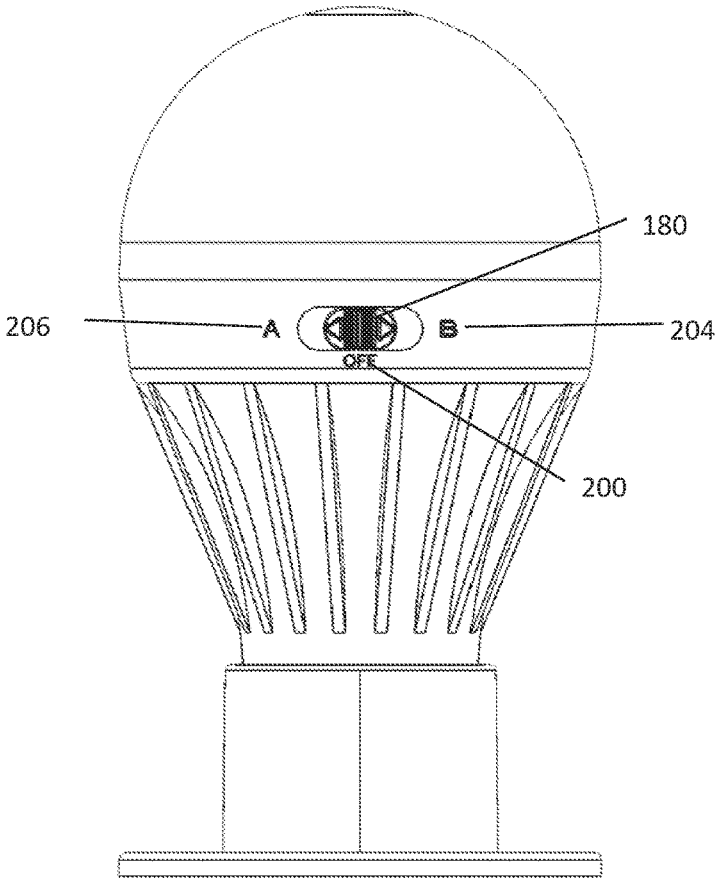
FIG. 14 is a side view of the bulb connected to the bracket, showing the bulb having a channel selector.

It may be desirable to control multiple bulbs 14 utilizing a single module 11 and/or to use different remotes 11 to control different bulbs 14 when they are within close proximity (e.g., within the same room) to one another. To facilitate this arrangement, the wireless communication device 126 contained within the modules 11, 311 and the control circuitry 102 contained within the bulbs 14 may have the ability to switch between a plurality of communication channels, including an A Channel 202 and a B Channel 204, as shown in FIGS. 12*a*, 13*a* and 14. Separate channels help ensure that the user can control each bulb 14 with the desired module 11, 311. These channels may eliminate undesired cross-talk between multiple modules 11, 311 by using different frequencies or modulations. Although only two channels are shown, the module 11, 311 can be configured with additional channels to expand the functionality of the modules 11, 311.

To select or change the communication channel, the module 11, 311 and the bulb 14 may contain a channel selector 180, best shown in FIGS. 12-14. For example, the channel selector 180 may be positioned to select Channel A 202, Channel B 204, or OFF 200. This selection of a channel by the channel selector 180 controls the circuitry inside of the module 11, 311 and the bulb 14, which in turn changes the channel that is utilized by the internal wireless communication devices of the module 11, 311 and the bulb 14.

To pair or connect the bulb 14 to the module 11, 311, the channel selectors 180 on both of these devices must be set to the same channel (e.g., Channel A 202). Once the channel selectors 180 on both the bulb 14 and module 11, 311 are set to the same channel (e.g., Channel A 202), the user can use the module 11, 311 to control the operational mode or illumination of the internal light source 100, as discussed above. It should be noted, that additional bulbs 14 that are within close proximity (e.g., the same room) and set to the same channel (e.g., Channel A 202) will be controlled by the single module 11, 311. In other words, the user can control multiple bulbs 14 with a single module 11 by setting the channel selectors 180 on each device to the same channel. This may be desirable when the user wants to place multiple bulbs 14 within a room and wants one module 11, 311 to operate all of the bulbs 14 in that room.

Alternatively, the bulb 14 channel selector 180 may be set to one channel (i.e. Channel A 202), while the module 11, 311 channel selector 180 is set to a different channel (i.e., Channel B 204). In this situation, the module 11, 311 will not be paired or connected to the bulb 14; this in turn prevents the module 11, 311 from controlling the bulb 14. This arrangement may be desired by the user when the user has multiple bulbs 14 within close proximity to one another and does not want the module 11, 311 to control all of the bulbs 14. For example, the user may have installed the mounting bracket 18 in the closet and the module 11, 311 on the wall, while having extra bulbs 14 in the closet. In this situation, the user may desire to place the module 11, 311 to Channel A 202 and the mounted bulb 14 to Channel A 202, while setting the extra bulbs 14 to different channels (e.g., Channel B 204) or positions (e.g., OFF 200) to ensure that the extra bulbs 14 are not illuminated when the module 11, 311 is activated.

Another operational example is when the user desires a bulb 14 that is installed in the entry of a house to illuminate once they walk into the entry point, while ensuring that a bulb 14 located in the closet only illuminates when another module 11 is activated, while further ensuring that the bulb 14 located under the sink is not illuminated when either module 11, 311 is activated. In this example, the user may utilize and set the module 311 to Channel A 202 and place it at the baseboard of the wall in a location where the sensing unit 350 will detect motion when the user enters the entry point. The user may also utilize and set a module 11 to Channel B 204 and place it in an easy to reach location near the closet entrance. Finally, the user may set the bulb 14 that is under the sink to the OFF 200 setting. This example is one of multiple examples that could be desired in the configuration of multiple bulbs 14, modules 11, 311, and channels 200-204.

The disclosed wireless portable light source system 10 enables numerous benefits over prior lighting systems. Unlike a lighting system that merely offers wireless functionality or merely offers portable functionality, the present disclosure provides for a system that synergistically and advantageously combines at least all of these features to create a unified system providing flexibility, portability and remote operation capabilities.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Other implementations are also contemplated.

The invention claimed is:

1. A portable light bulb system, comprising:

a bulb including:

a housing, a manually-operated switch, a main body having a base and an elongated neck disposed between the housing and the base, the base having a plurality of rings that extend outwardly from an outer surface of the base and not forming a continuous thread, wherein the base in combination with the rings are sized and configured to prevent the base from being inadvertently inserted into a conventional 110 volt electrical light bulb socket, a multi-positional securement member that is operably connected to the base, the multi-positional securement member configured to be positioned in at least a deployed position or a retracted position, wherein in the deployed position, the multi-positional securement member extends beyond the recess, and wherein in the retracted position, the multi-positional securement member resides within the recess, and a light source disposed within the bulb to provide illumination through the housing and configured to be operably connected to a power source;

a mounting bracket having a projection extending from a bracket flange, the projection defining a receiver that receives an extent of the base to releasably couple the bulb to the mounting bracket, wherein said mounting bracket lacks components that would allow the mounting bracket to be operably connected to an AC power source;

wherein the portable light bulb system is configurable in a first use position where (i) the mounting bracket is affixed to a support surface and (ii) operation of the bulb provides illumination to a region proximate the mounting bracket; and wherein the portable light bulb system is configurable in a second use position where (i) the bulb is disconnected from the mounting bracket and brought by a user to a second region distant from the mounting bracket and (ii) operation of the bulb provides illumination to the second region.

2. The portable light bulb system of claim 1, wherein a disconnection force is applied to the bulb to remove it from the first use position, the disconnection force being applied substantially perpendicular to the bracket flange, thereby allowing the bulb to be removed from the mounting bracket.

3. The portable light bulb system of claim 2, wherein the disconnection force does not require angular movement of the bulb.

4. The portable light bulb system of claim 1, wherein the base has a diameter, said diameter of the base is larger than a diameter of a conventional 110 volt light bulb to prevent the base from being inadvertently placed in a conventional 110 volt electrical light bulb socket.

5. The portable light bulb system of claim 1, wherein the base includes a bulb magnet, said magnet allows a lower surface of the bulb to be releasably attached to a magnetic surface in the second use position.

6. The portable light bulb system of claim 5, wherein a connector is adhered to a bottom of the receiver, said connector is operable with the base to releasably couple the bulb to the mounting bracket in the first use position.

7. The portable light bulb system of claim 6, wherein the connector is a metallic disk, said metallic disk releasably couples the bulb to the mounting bracket through a magnetic force in the first use position.

8. The portable light bulb system of claim 1, wherein the receiver is substantially circular and lacks internal threads and the base is substantially circular and lacks external threads.

9. The portable light bulb system of claim 1, wherein the manually-operated switch is configured to change operational mode of the light source, said operational mode is chosen from one of the following: (i) bright, (ii) dim, or (iii) off.

10. The portable light bulb system of claim 1, wherein the projection has an outer surface and the bracket flange has an upper surface, said outer surface of the projection is substantially perpendicular to the upper surface of the bracket flange.

11. The portable light bulb system of claim 1, wherein the mounting bracket includes a multiple surface securement system, said multiple surface securement system includes both adhesive for securing the mounting bracket to a support surface and at least aperture configured to receive a mechanical fastener for securing the mounting bracket to a support surface.

12. The portable light bulb system of claim 1, wherein the power source includes a removable battery cartridge that resides within main body, said removable battery cartridge is configured to accept a plurality of non-rechargeable batteries; and the bulb lacks components that would allow it to be powered by 110 volt power source.

13. A remote controlled portable light bulb system, comprising:

a bulb including:

a housing, a manually-operated switch, a main body having: a base and a neck disposed between the housing and the base, the base having a plurality of rings that extend outwardly from an outer surface of the base and that are arranged to not form a continuous thread, wherein the base and the rings are configured to prevent the base from being inadvertently inserted into a conventional 110 volt electrical light bulb socket, a multi-positional securement member that is operably connected to the base, the multi-positional securement member configured to be positioned in at least a deployed position or a retracted position, wherein in the deployed position, the multi-positional securement member extends beyond the recess, and wherein in the retracted position, the multi-positional securement member resides within the recess, and a light source disposed within the bulb to provide illumination through the housing and configured to be operably connected to a battery, said light source having a plurality of operational modes, a wireless communication device; and a remote module placed at a region distant from the bulb, said the remote module having a wireless communication device that is operable with the wireless communication device of the bulb;

wherein the remote controlled portable light bulb system is configurable in a first use position where (i) the bulb is affixed to a support surface, (ii) operation of the bulb provides illumination to region proximate the supported surface and (iii) the illumination of the bulb is controlled by the remote module; and wherein the remote controlled portable light bulb system is configurable in a second use position where (i) the bulb is brought by a user to a second region distant from the support surface and (ii) the illumination of the bulb is controlled by the manually-operated switch.

14. The remote controlled portable light bulb system of claim 13, wherein the plurality of operation modes includes at least three of the following modes: (i) bright, (ii) dim, (iii) flashing, or (iv) off.

15. The remote controlled portable light bulb system of claim 13, wherein the remote module includes either a module switch or a wireless motion sensor, said remote module is configured to change operational mode of the light source.

16. The remote controlled portable light bulb system of claim 13, wherein the remote module includes multiple mounting features for securing remote module to a surface.

17. The remote controlled portable light bulb system of claim 13, wherein the wireless communication device of the bulb and the wireless communication device of the remote module each have a plurality of communication channels; and wherein the same communication channel is selected from the plurality of communication channels on the wireless communication device of the bulb and the wireless communication device of the remote module to enable the remote module to communicate with the bulb.

18. The remote controlled portable light bulb system of claim 13, further comprising a mounting bracket having a projection extending from a bracket flange, the projection defining a receiver that receives an extent of the base to releasably couple the bulb to the mounting bracket in the first use position, wherein said mounting bracket lacks components that would allow the mounting bracket to be operably connected to an AC power source.

19. The remote controlled portable light bulb system of claim 18, wherein a disconnection force is applied to the bulb to remove it from the mounting bracket, the disconnection force being applied substantially parallel to a longitudinal axis of the bulb to thereby allow the bulb to be moved from the first use position to the second use position.

20. The portable light bulb system of claim 1, wherein the main body further includes a collar extends between the neck and the housing, and wherein the switch is disposed in the collar.

21. The portable light bulb system of claim 20, wherein the neck has a curvilinear outer wall that extends between the collar and an upper extent of the base.

22. A portable light bulb system, comprising:

a bulb including:

a plastic housing, a plurality of batteries removably disposed within the bulb, a base having a recess, wherein said base is sized and configured to prevent the base from being inadvertently inserted into a conventional 110 volt electrical light bulb socket, a main body coupled to the housing and having an external thread that engages an internal thread of the base to releasably couple the base to the main body, wherein the base is configured to be removed from to the main body to allow the plurality of batteries to be either: (i) added, (ii) removed, or (iii) replaced, a multi-positional securement member that is operably connected to the base, the multi-positional securement member configured to be positioned in at least a deployed position or a retracted position, wherein in the deployed position, the multi-positional securement member extends beyond the recess, and wherein in the retracted position, the multi-positional securement member resides within the recess, and a light-emitting diode disposed within the bulb to provide illumination through the housing and configured to be operably connected to the plurality of batteries; and a plastic mounting bracket having a projection extending from a bracket flange, the projection defining a receiver that receives an extent of the base to releasably couple the bulb to the mounting bracket, wherein said mounting bracket lacks both a continuous internal thread and components that would allow the mounting bracket to be operably connected to an AC power source.

23. The portable light bulb system of claim 22, wherein the base has at least three rings that are arranged substantially parallel to each other and not forming a continuous thread.

24. The portable light bulb system of claim 22, wherein the base includes a bulb magnet and the mounting bracket includes a metallic disk that is adhered to a bottom of the receiver, said metallic disk is operable with the magnet to releasably couple the bulb to the mounting bracket.

25. The portable light bulb system of claim 22, wherein the mounting bracket includes a multiple surface securement system, said multiple surface securement system includes both adhesive for securing the mounting bracket to a support surface and at least aperture configured to receive a mechanical fastener for securing the mounting bracket to a support surface.

* * * * *